US009173810B2

(12) United States Patent
Tran

(10) Patent No.: US 9,173,810 B2
(45) Date of Patent: Nov. 3, 2015

(54) PEDICURE SPA WITH SELF-CLEANING RETRACTABLE BASIN

(71) Applicant: Newton Tran, Las Vegas, NV (US)

(72) Inventor: Newton Tran, Las Vegas, NV (US)

( * ) Notice: Subject to any disclaimer, the term of this patent is extended or adjusted under 35 U.S.C. 154(b) by 462 days.

(21) Appl. No.: 13/691,091

(22) Filed: Nov. 30, 2012

(65) Prior Publication Data

US 2014/0150176 A1 Jun. 5, 2014

(51) Int. Cl.
*A61H 35/00* (2006.01)
*A61H 33/00* (2006.01)

(52) U.S. Cl.
CPC ..... *A61H 35/006* (2013.01); *A61H 33/0087* (2013.01); *A61H 33/6089* (2013.01); *A61H 2033/0016* (2013.01); *A61H 2201/0149* (2013.01); *A61H 2205/10* (2013.01); *A61H 2205/12* (2013.01)

(58) Field of Classification Search
CPC ..... A61H 35/006
USPC ..... 4/622, 621
See application file for complete search history.

(56) References Cited

U.S. PATENT DOCUMENTS

| | | | | |
|---|---|---|---|---|
| 6,732,387 | B1 * | 5/2004 | Waldron | 4/622 |
| 8,104,114 | B2 | 1/2012 | Ton | |
| 8,214,937 | B2 | 7/2012 | Lawyer et al. | |
| 2010/0301640 | A1 * | 12/2010 | Heiser | 297/135 |

FOREIGN PATENT DOCUMENTS

WO WO 2010/138375 12/2010

* cited by examiner

*Primary Examiner* — Tuan N Nguyen
(74) *Attorney, Agent, or Firm* — Lightbulb IP, LLC

(57) ABSTRACT

A pedicure spa having a self-cleaning retractable basin provides a consistently cleaned and sanitized basin for use during a pedicure treatment. A cleansing chamber in the pedicure spa accepts the basin for a self-cleaning procedure. Cleansing products may be dispensed from one or more supply components for application to the basin by one or more cleansing devices. The self-cleaning procedure may proceed according to one or more predefined stages, which may include a drying stage provided by one or more dryers within the cleansing chamber.

20 Claims, 4 Drawing Sheets

PEDICURE SPA WITH SELF-CLEANING RETRACTABLE BASIN

BACKGROUND OF THE INVENTION

1. Field of the Invention

The invention relates to pedicure spas, and in particular to pedicure spa with a self-cleaning retractable basin.

2. Related Art

Pedicure treatments have been a popular form of grooming nearly throughout history. Various tools, such as files, clippers, and pumice stones have been developed to provide improved pedicures. Today, pedicures are often provided to clients via an apparatus known as a pedicure spa. In general, a pedicure spa helps properly position a client for a treatment while providing a comfortable seat upon which the client may relax during a treatment.

As can be seen however, these tools are client oriented in that they aid in improving the quality of pedicure treatments that a client receives. With ever growing popularity there is a need for tools that assist pedicure specialists in preparing and providing pedicure treatments.

From the discussion that follows, it will become apparent that the present invention addresses the deficiencies associated with the prior art while providing numerous additional advantages and benefits not contemplated or possible with prior art constructions.

SUMMARY OF THE INVENTION

A pedicure spa with a self-cleaning retractable basin is disclosed herein. The self-cleaning pedicure spa ensures that its basin is cleaned and sanitized for its next pedicure treatment. The self-cleaning process may be automated to various degrees. In this manner, a pedicurists effort and time can be focused on providing pedicure treatments rather than on the time consuming and labor intensive task of cleaning. In this manner, the pedicurist can better provide pedicure treatments to his or her customers. In addition, the self-cleaning procedure results in consistently cleaned and sanitized basins thus providing a clean and healthy environment for the pedicurist and clients.

Various systems and methods related to the pedicure spa herein are disclosed. In on embodiment for example, a self-cleaning pedicure spa is disclosed. Such pedicure spa may comprise a body having a front end and a back end, a seat supported by the body at the back end, and a retractable basin movable between an extended position and a retracted position and configured to hold at least on liquid therein for use during a pedicure treatment when in the extended position.

A cleansing chamber will typically be within the back end of the body and having an opening to accept the retractable basin. During the self-cleaning process, one or more cleansing devices within the cleansing chamber apply one or more cleansing products to the retractable basin when the retractable basin is in the retracted position.

It is noted that the seat may be located above the cleansing chamber. In addition, the back end of the body may be taller than the front end of the body, such as to elevate the seat or provide a cleansing chamber of adequate size. The body may form a platform at its front end for supporting the retractable basin when the retractable basin is in the extended position. A stop may be provided to releasably secure the retractable basin within the cleansing chamber.

One or more supply components may be used to store and dispense the one or more cleansing products to the one or more cleansing devices. It is contemplated that at least one of the one or more cleansing devices are coupled to a municipal water supply.

In another exemplary embodiment, a self-cleaning pedicure spa may comprise body having a seat configured to support a client during a pedicure treatment, a retractable basin configured to hold at least one liquid for use during the pedicure treatment, and a cleansing chamber within the body and having an opening to accept the retractable basin.

One or more supply components are typically provided to dispense one or more cleaning products. During the self-cleaning process, a plurality of cleansing devices within the cleansing chamber and coupled to the one or more supply components apply the one or more cleansing products to the retractable basin when the retractable basin is in the cleansing chamber. A controller may be used to control application of the one or more cleansing products to the retractable basin according to one or more predefined self-cleaning stages.

It is noted that a drain may be included to drain the cleansing chamber. In addition or alternatively, the drain may be configured to engage an outlet of the retractable basin to drain the retractable basin. A pump may be provided to transfer the one or more cleansing products from the one or more supply components to the one or more cleansing devices. In addition, a dryer may be used to dry the retractable basin when the retractable basin is in the cleansing chamber. Also, a stop may be provided to releasably secure the retractable basin within the cleansing chamber.

As stated various methods are disclosed herein as well. In one exemplary embodiment, a method of cleansing a basin at a self-cleaning pedicure spa is provided. Such method may comprise providing a seat to support a client during a pedicure treatment, positioning a basin within a cleansing chamber of the pedicure spa, and activating one or more self-cleaning stages whereby one or more cleansing products are applied to the basin by one or more cleansing devices within the cleansing chamber. The basin will typically be removed from the cleansing chamber to position the basin to accept a client's feet, such as when providing a pedicure treatment to a client.

One or more cleansing products may be stored in one or more supply components coupled to the one or more cleansing devices. At least one of the one or more supply components may be coupled with to a municipal water source. A stop may be activated or engaged to hold the basin within the cleansing chamber. The cleansing chamber may be drained by opening its drain.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The components in the figures are not necessarily to scale, emphasis instead being placed upon illustrating the principles of the invention. In the figures, like reference numerals designate corresponding parts throughout the different views.

DETAILED DESCRIPTION OF THE PREFERRED EMBODIMENTS

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

In general, the self-cleaning pedicure spa herein benefits pedicure providers or specialists (hereinafter "pedicurists") by aiding in the preparation process that occurs prior to providing a pedicure treatment to a client. Typically, the pedicure spa will include a basin that is self-cleaning. The self-cleaning process results in a consistently clean and sanitized basin that is ready for use during the next pedicure treatment. In addition, this reduces the pedicurists' workload so that their effort can be saved for providing treatments. The time for preparing tools and other equipment for a treatment is also reduced.

Figure 1A:
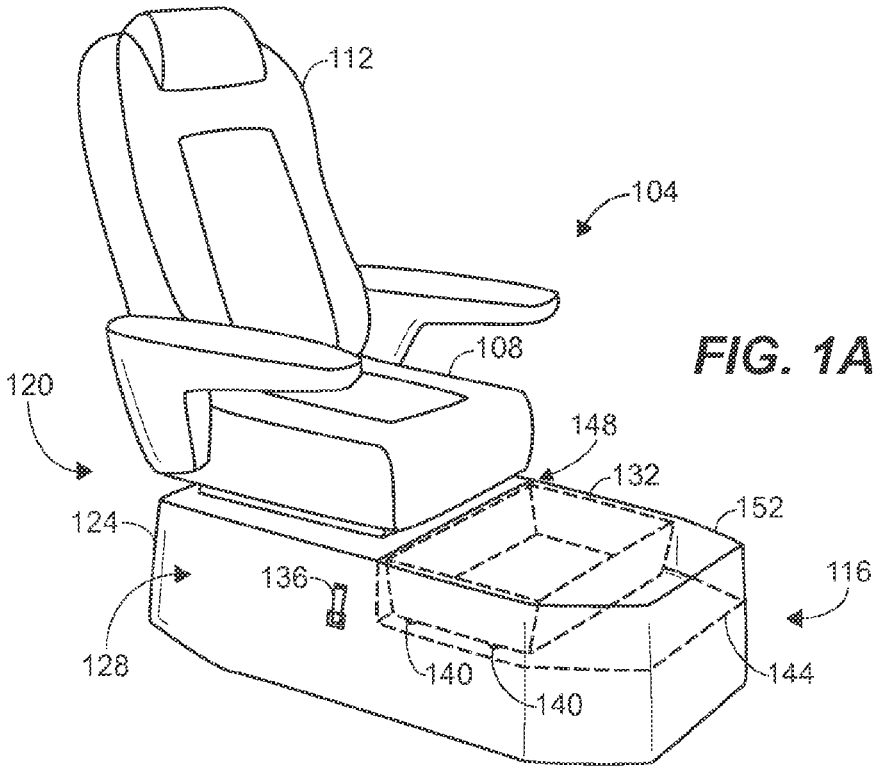
FIG. 1A is a perspective view of an exemplary self-cleaning pedicure spa with its basin in an extended position.
Figure 1B:
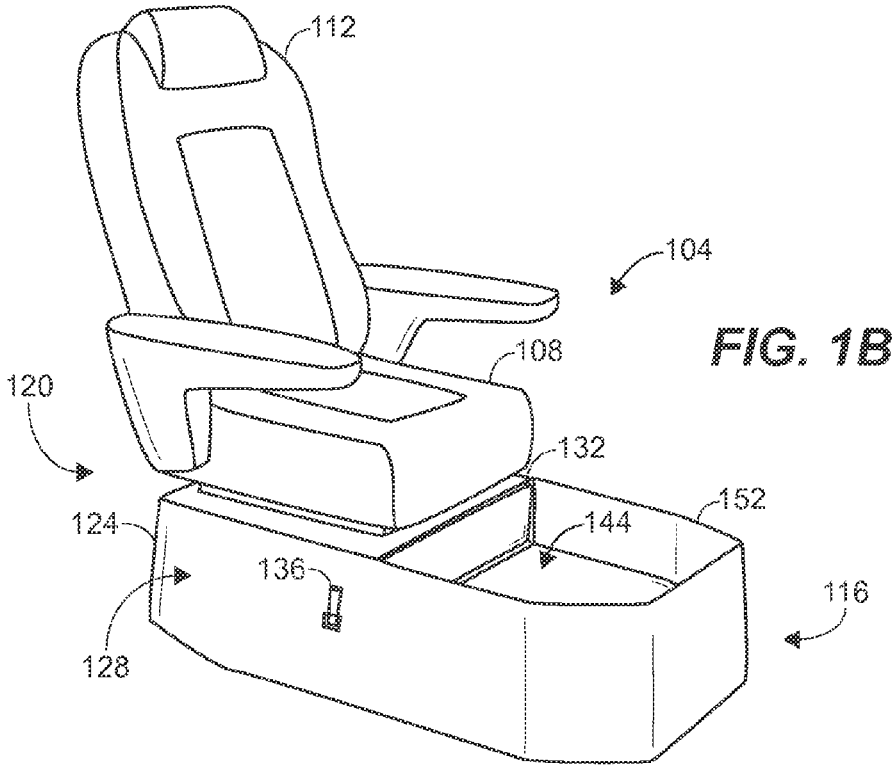
FIG. 1B is a perspective view of an exemplary self-cleaning pedicure spa with its basin in a retracted position.

FIGS. 1A and 1B provide a perspective view of an exemplary pedicure spa 104 with a self-cleaning retractable basin 132 in an extended and retracted position, respectively. As will be described further below, the retractable basin 132 may be retracted for the self-cleaning process and for storage, and subsequently extended for use.

As can be seen, the pedicure spa 104 may comprise a body 124 configured to support various of its components. As shown for example, the body 124 is an "L" shaped structure providing support to a seat 108, backrest 112, and an cleansing chamber 128 at the back end 120 of the pedicure spa. The body 124 may be configured to form and/or support a platform or other structure configured to receive and hold the retractable basin 132. As can be seen from FIGS. 1A and 1B for example, the body 124 has a platform 144 at its front end 116 that supports the retractable basin 132.

One or more walls 152 may surround the platform 144. For example, as shown, one or more walls 152 may extend upward from the platform 144 to surround the platform. In this manner, any liquid spills from the basin 132 can by contained within the walls 152 of the pedicure spa 104. As will be described further below, the body 124 may be shaped or otherwise configured to guide these spills to a drain where they may be evacuated from the pedicure spa 104.

The back end 120 of the pedicure spa 104 may be elevated over the front end 116. In one or more embodiments, this increases the space available for the pedicure spa's cleansing chamber 128. In addition, this allows the seat 108 and backrest 112 to be elevated to provide a comfortable seating position for a client while positioning the clients feet at a comfortable position for a pedicurist (seated at the front end 116 of the pedicure spa 104) to provide a treatment.

It will be understood that the body 124 may have be formed in various shapes while still providing the support functions disclosed above and while providing sufficient space for an cleansing chamber 128 to receive the retractable basin.

As its name implies, the retractable basin 132 may move into and out of the cleansing chamber 128 of the pedicure spa 104. An opening 148 in the cleansing chamber 128 is provided to allow the retractable basin 132 to move into and out of the cleansing chamber. In the embodiment of FIGS. 1A and 1B the retractable basin 132 is shown as having wheels 140 to allow it to easily move between a retracted position and an extended position. It is contemplated that the retractable basin 132 may be made movable/retractable in various ways. For example, the retractable basin 132 may be mounted to a sliding track or other guide track with or without wheels. In addition, movement may be achieved by ball bearings or the like.

Also, it is contemplated that the retractable basin 132 could slide into and out of the cleansing chamber 128 without wheels 140 or any other movable supports or mounts. In such embodiments, at least a portion of the outer surface of the retractable basin 132 and/or body 124 may be smoothed or covered with a friction reducing material so as to reduce friction. It is noted that a stop 136 may be provided to hold the retractable basin 132 in a desired position. For example, a stop 136 may hold the retractable basin 132 in a extended position, such as shown in FIG. 1A. Alternatively, the same or a different stop 136 may hold the retractable basin 132 in a retracted position, such as shown in FIG. 1B. A lever, switch, button or other user engageable mechanism may be provided to engage and disengage the stop, thereby securing or releasing the retractable basin 132.

The retractable basin 132 will typically be used to hold or contain various liquids, compounds, or formulations used during a pedicure treatment. It is contemplated that the retractable basin 132 may comprise one or more Jacuzzi™ or massage nozzles, magnet/magnetic jets, other agitators, or the like to agitate liquid or other materials held within the retractable basin. This creates a soothing/relaxing sensation for the client's feet.

In addition, it is noted that the pedicure spa 104 may include various accessories for use by a pedicurist during a pedicure treatment. For example, the pedicure spa 104 may comprise one or more handheld or fixed faucets to supply water during a pedicure treatment. Handheld faucets may be attached to an extension hose or the like to allow the pedicurist to easily position the faucet, such as to apply water to the client's feet, the retractable basin 132, the platform 144, or walls 152 of the pedicure spa 104.

Figure 2:
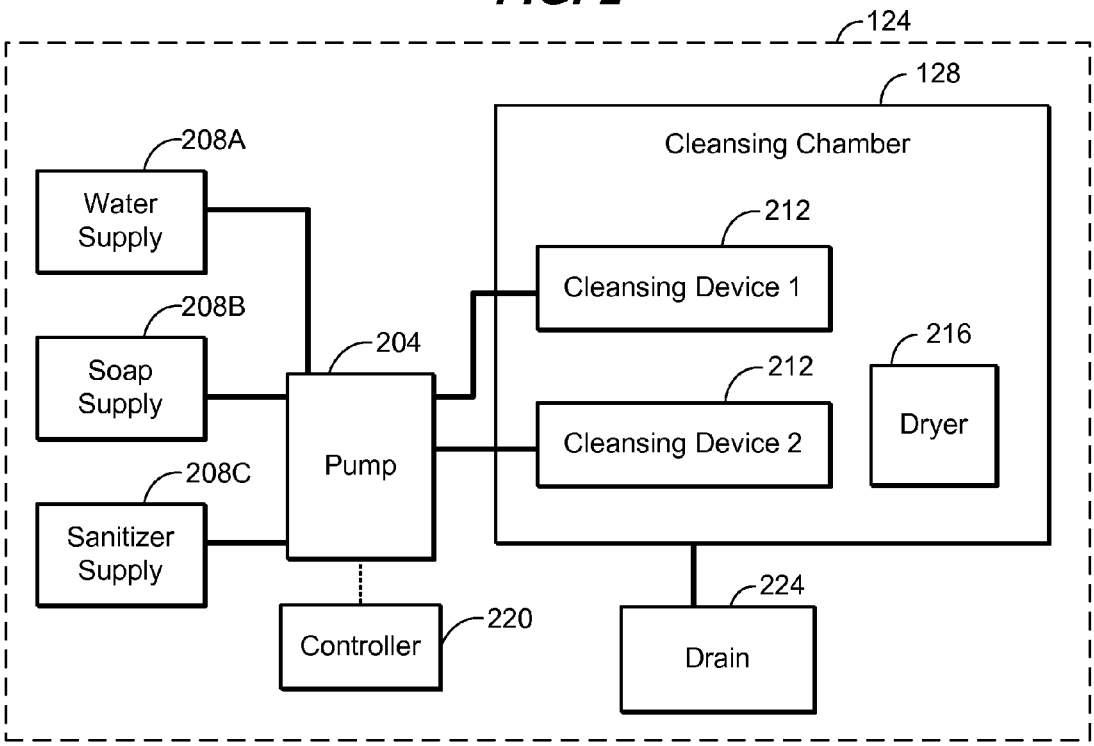
FIG. 2 is a block diagram illustrating components of an exemplary self-cleaning pedicure spa.

FIG. 2 is a block diagram illustrating components of an exemplary pedicure spa 104 that may be used to provide its self-cleaning function. Though shown as being within the pedicure spa's body 124 (so as to hide them from view and protect them from tampering) it is noted that one or more components may be external to the body 124 in some embodiments. In such embodiments, it is contemplated that the components may have their own enclosures.

As can be seen, the pedicure spa 104 may have various supply components 208 to distribute cleansing products for use during the self-cleaning procedure. In general, the cleansing products will be chemicals, formulations, or the like that are used to clean and sanitize a retractable basin during the self-cleaning process. This ensures that the retractable basin is clean and sanitary for the next pedicure treatment. And since the cleansing products are applied by a mechanical process at the pedicure spa, the retractable basin is consistently cleaned and sanitized for each pedicure treatment. This provides a healthy and clean environment for the pedicurist and his or her clients.

In FIG. 2 for example, it can be seen that soap and sanitizer or the like may be provided from a soap supply component 208B and sanitizer supply component 208C. Water for use in combination with one or more soaps and/or sanitizers, for rinsing, or both may be provided by a water supply component 208C. It is noted that soap and/or sanitizer may be stored and dispensed by a supply component 208 in solid or liquid form.

In some embodiments, a supply component 208 may be a container or compartment for storage and subsequent dispensing of cleansing products, such as those described in the foregoing. In such embodiments, a supply component 208 may be refillable when its cleansing product is low or exhausted. In other embodiments, a supply component 208 may provide a connection to a source for one or more cleansing products. For example, the water supply component 208A may be configured to couple the pedicure spa 104 to a municipal or other water supply. Likewise, other supply components 208 may similarly couple the pedicure spa 104 to a central or shared soap and/or sanitization product supply.

A pump 204 or other distribution device may be provided to transfer a cleansing product from its supply component 208 to the cleansing chamber 128. In the case of a liquid cleansing product, a pump 204 may be used. In the case of a solid cleansing product, the distribution device may be a release mechanism which releases a quantity of the cleansing product into the cleansing chamber 128. It is contemplated that solid cleansing products may be mixed with one or more liquids by a mixing device, that comingles the cleansing products, before they are released in the cleansing chamber 128. Two or more liquids could also be mixed in this manner.

The pump 204 may contain a mixing device or a mixing device may be provided separately. It is noted that a plurality of pumps 204 or other distribution devices may be included in some embodiments. In this manner, one or more cleansing products may be distributed by their own distribution device. It is also noted that a supply component 208 may have its own pump or distribution device. In addition, some cleansing products, such as water, may be provided under pressure or via a pressurized supply component 208 and thus would naturally travel to the cleansing chamber 128. In such embodiments, a separate pump 204 or distribution device may not be necessary.

As alluded to above, cleansing products will typically travel from their respective supply components 208 to the cleansing chamber during the self-cleaning procedure. As shown in FIG. 2, one or more conduits, such as pipe, may be used to connect one or more supply components 208, pumps 204, and the cleansing chamber 128 to permit such distribution of the cleansing products.

In general, a cleansing chamber 128 will typically be configured as a compartment or container where the self-cleaning process can occur. In one or more embodiments, the cleansing chamber 128 may be water-tight for example to prevent cleansing products from escaping. The cleansing chamber 128 may be insulated to reduce noise and to preserve the temperature (i.e., heat) of cleansing products if necessary. Typically, the cleansing chamber 128 will be coated or formed from a material that can itself be easily cleaned and is impervious to water damage.

As can be seen from FIG. 2, the cleansing chamber 128 may contain one or more cleansing devices 212 that apply soap, sanitizer, water or other cleansing products to a retractable basin during the self-cleaning process. In one exemplary embodiment, the cleansing devices 212 may be spray nozzles that apply the cleansing products to a retractable basin by a pressurized spray. It is noted that separate cleansing devices 212 may be used to apply different cleansing products. For example, soap and/or sanitizer may be applied by a first cleansing device 212 while rinsing occurs through a second cleansing device.

One or more dryers 216, utilizing heat, air, or both (for example) may also be provided by the cleansing chamber 128 to dry a newly cleaned retractable basin as well as the cleansing chamber itself. For example, the cleansing chamber 128 may comprise one or more heating elements and/or blowers to dry the retractable basin and/or the cleansing chamber itself. It is noted that a heated dry may be part of the sanitization process in some embodiments.

It is contemplated that a controller 220 may be provided in some embodiments to control operation of the pedicure spa's components during the self-cleaning process. The controller 220 may be a mechanical, electronic, or electromechanical device configured to orchestrate the components during the self-cleaning process. For example, the controller 220 may control the sequence in which cleansing products are applied to the retractable basin, such as by controlling operation of one or more pumps 204 or cleaning devices 212. This allows soap and sanitizer to be applied according to a predefined sequence. For example, the retractable basin may be cleaned with soap before being sanitized. Water may then be applied to rinse the retractable basin once cleaning and sanitization are complete. The controller 220 may then activate one or more dryers 216. It is noted that cleansing products, such as scented compounds, may be applied lightly after the cleansing/sanitization or drying process is complete. It is noted that one or more communication links or electrical power connections may extend from the controller 220 to the component or components it is configured to control.

In addition, the controller may control the length of time particular cleansing products are applied to the retractable basin such as to ensure the retractable basin is sufficiently cleaned, sanitized, rinsed, and/or dried. It is noted that in some embodiments, a controller 220 may provide one or more preprogrammed cleansing sequences that can be selected by the pedicurist. This is beneficial in that in cases where a heavier cleaning or rinsing is necessary for example.

A drain 224 may be provided to allow the cleansing products to be evacuated from the cleansing chamber 128. It is noted that the drain 224 may be connected to a municipal sewer or the like. Alternatively, the drain 224 may connect to a repository that can be emptied as needed. The drain 224 may be opened or closed in some embodiments, such as by a pedicurist or by a controller 220. Alternatively, the controller 220 may be configured to control opening and closing of the drain 224 during the self-cleaning process. In this manner, the retractable basin may be automatically drained after application of one or more cleansing products or only during the drying process for example. It is noted that multiple drains 224 may be provided to provide drainage for the retractable basin 132, the cleansing chamber 128, or both.

Figure 3A:
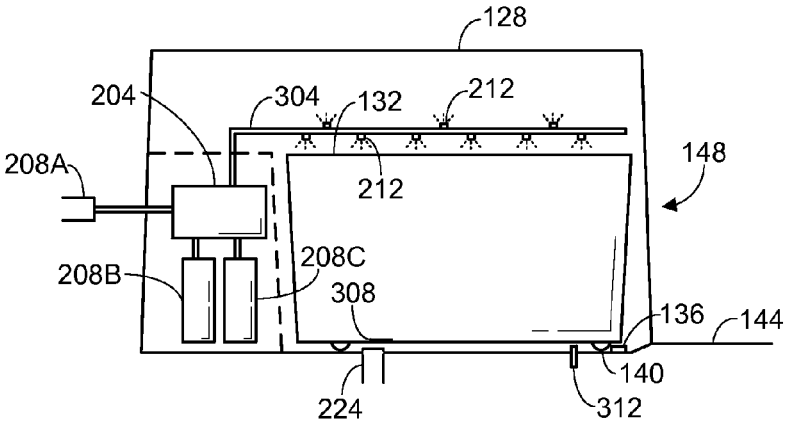
FIG. 3A is a side view of an exemplary cleansing chamber.
Figure 3B:
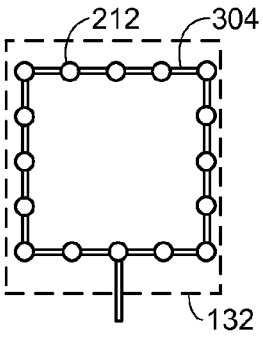
FIG. 3B is a top view of an exemplary cleansing chamber.

FIGS. 3A and 3B illustrate an exemplary cleansing chamber 128 and components thereof. FIG. 3A provides a side view of the cleansing chamber 128 having a retractable basin 132 therein for cleaning. It is noted that some components of the pedicure spa may be enclosed, covered or otherwise protected such as shown by the dashed enclosure in FIG. 3A.

As can be seen, the retractable basin 132 is contained within the cleansing chamber 128 during the self-cleaning process. FIG. 3A also shows an embodiment where the platform 144 extends or slants downward as it enters the cleaning chamber 128. This causes any liquid that escapes the basin 132 (in its extended or retracted position) to flow downward towards a drain 224 of the pedicure spa.

Typically, the opening 148 of the cleansing chamber 128 and the retractable basin 132 will be configured to enclose the opening when the retractable basin 132 is in the cleansing chamber for cleaning. For example, at least one wall of the retractable basin 132 may be sized and shaped to closely conform to the size and shape of the opening 148 so as to seal or enclose the opening. It is contemplated that one or more gaskets or the like may be at the opening to ensure that a seal is made. In this manner, cleansing products can be contained within the cleansing chamber 128 during the self-cleaning process. Alternatively, it is contemplated that a door or the like could be provided to enclose the cleansing chamber 128.

As can be seen, one or more cleansing devices 212 may be mounted to a support 304 within the cleansing chamber 128. As shown for example, the cleansing devices 212 are suspended above the retractable basin 132 such that cleansing products can be sprayed or otherwise applied in a downward direction. This causes dirt, debris, and other unwanted material to flow downward towards an outlet 308 of the retractable basin 132 and ultimately to the drain 224 of the cleansing chamber 128. It is noted that the support 304 may also be configured as a conduit through which cleansing products may be supplied to the cleansing devices 212.

FIG. 3B provides a top view of an interior portion of the cleansing chamber 128. The arrangement of cleansing devices 212 can be seen in this view. As can be seen, in one or more embodiments, the cleansing devices 212 may be positioned to correspond to the shape of the retractable basin 132. It is noted that the cleansing devices 212 may be directed or targeted towards various sections of the retractable basin 132 to ensure that cleansing products are applied to the various sections of the basin and the basin is thoroughly cleaned. Various components of a retractable basin 132, such as the basin's magnet jet or other agitator, may also be targeted for cleaning/sanitization.

It is contemplated that the cleansing devices 212 may spin or swivel during the self-cleaning process in one or more embodiments. In addition, a cleansing device 212 may have various nozzles or guides used to apply cleaning products in different manners. For example, a more narrowly focused spray may be used during cleaning/sanitization stages while a more dispersed spray is used for rinsing purposes. The cleansing devices 212, supply components, pump or various combinations thereof may be configured to provide cleansing products at various rates. In this manner, a larger volume of cleansing products can be applied during the cleaning/sanitization stage as compared to a rinsing stage for example.

In addition, one or more cleansing devices 212 may optionally be positioned or be moved to apply cleansing products to the cleansing chamber's walls to clean the cleansing chamber 128 itself. This is shown by the cleansing devices 212 directed outward from the basin 132.

One or more supports 304 may be provided for various cleansing devices 212. For example, a separate support 304 may be used to support and provide cleansing products to a first set of cleansing devices 212, while another support has a second set of cleansing devices associated with (the same or different) cleansing products attached thereto.

Referring back to FIG. 3A, it can be seen that a drain 224 may accept liquids from an outlet 308 of the retractable basin 132 to allow the basin to be drained. As stated above, a lifting or tilting mechanism 312 may be movable to tip a portion of the basin 132 upward (or move a portion of the basin 132 downward) so that liquid contained therein flows toward and then out of the outlet 308. In some embodiments, the tilting mechanism 312 may be user operated, such as via a lever, switch, button or the like to raise and lower a portion of the basin 132. In other embodiments, a motor, actuator or the like may be used to actuate the tilting mechanism 312. In motorized embodiments, it is contemplated that a controller may operate the tilting mechanism 312. It is noted that the outlet 308 may be configured to open when the retractable basin 132 is tilted.

Also shown in FIG. 3A, is the stop 136 as described above. As can be seen, the stop 136 may physically prevent or allow the retractable basin 132 to move between its retracted and extended positions. The stop 136 may be user operated, such as via a lever, switch or the like. Alternatively, it is contemplated that the stop 136 may be motorized such as via a motor or actuator. In motorized embodiments, it is contemplated that the controller 220 may control the stop.

Operation of the self-cleaning process will now be described with reference to FIGS. 1A and 1B. In FIG. 1A, the retractable basin 132 is in an extendable position for use during application of a pedicure treatment. Once such treatment is complete, the retractable basin 132 may be moved into the cleansing chamber 128, such as shown in FIG. 1B for the self-cleaning process to being. As can be seen, a portion of the retractable basin 132 may enclose the opening 148 of the cleansing chamber 128 to contain cleansing products used during the self-cleaning process.

Typically, the self-cleaning process will comprise multiple stages or processes. For example, a self-cleaning process may include one or more cleaning stages where soap is applied, one or more sanitization stages where sanitizer is applied, one or more rinsing stages where water is applied, one or more drying stages, or various combinations thereof. In one typical embodiment, at least one cleaning stage is followed by at least one sanitization stage and rinsing stage. The drying stage may subsequently occur if desired. It is contemplated that a rinsing stage may occur between cleaning and sanitization stages. In addition, the sanitization stage may occur before the cleaning stage in some embodiments.

Once the self-cleaning (including any optional drying) is completed, the retractable basin 132 may be moved out of the cleansing chamber 128, such as shown in FIG. 1A for use. Typically, the pedicurist will extend and retract the retractable basin 132 manually. It is contemplated though that in some embodiments, the movement of the retractable basin 132 may be motorized.

As can be seen, the retractable basin 132 is thus cleaned and sanitized (and optionally dried) with little or no effort by the pedicurist. The self-cleaning process is typically also a rapid process to allow the next pedicure treatment to be applied with little waste of time. In addition, since the self-cleaning process takes place within the pedicure spa 104, the time and labor involved in moving the retractable basin 132 to a sink or other cleaning station is eliminated. This provides some time for a pedicurist to prepare for the next pedicure treatment or to enjoy a break before the next treatment. As a result the treatments provided by the pedicurist may have increased consistency and quality leading to increased customer satisfaction (in addition to the clean and sanitary work environment provided by the pedicure spa).

Figure 4A:
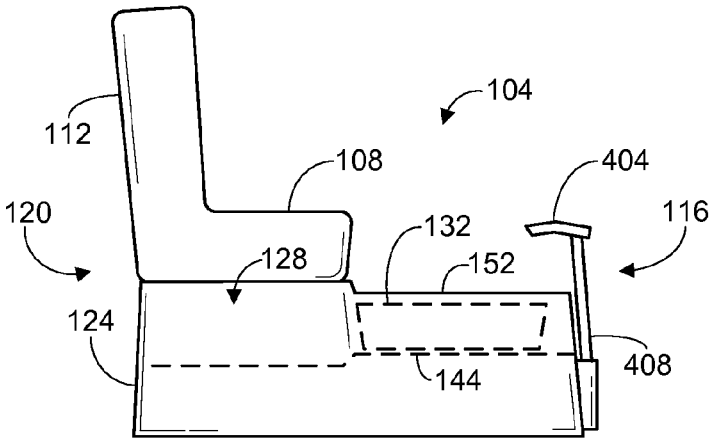
FIG. 4A is a side view of an exemplary self-cleaning pedicure spa with a pivoting footrest in a service position.
Figure 4B:
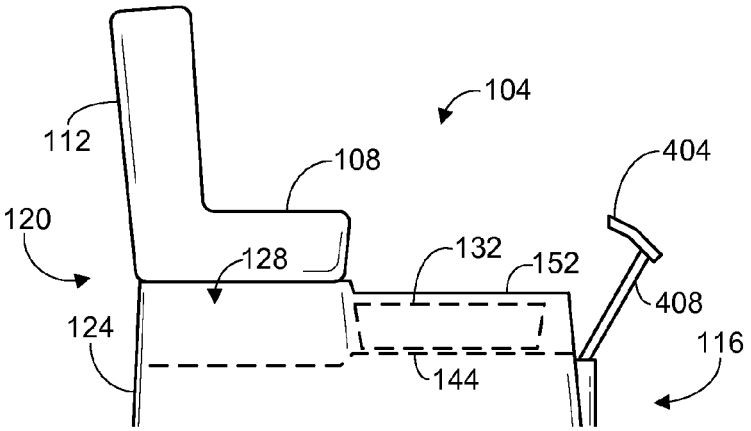
FIG. 4B is a side view of an exemplary self-cleaning pedicure spa with a pivoting footrest in a stowed position.

FIGS. 4A-4D illustrate various optional accessories that may be provided with the pedicure spa 104. FIGS. 4A-4B illustrate a pivoting or movable footrest 404 attached to the body 124 of the pedicure spa by a pivoting mount 408. A client's foot may be supported by the footrest 404 while the pedicurist is working on the foot, or to make room for other tools or equipment 416, such as a motorized leg and/or foot massager positioned at a front end 116 or platform of the pedicure spa. When no longer needed the footrest 404 may pivot or move away, such as shown in FIG. 4B. It is contemplated that the footrest 404 and mount 408 may be removable in some embodiments.

Figure 4C:
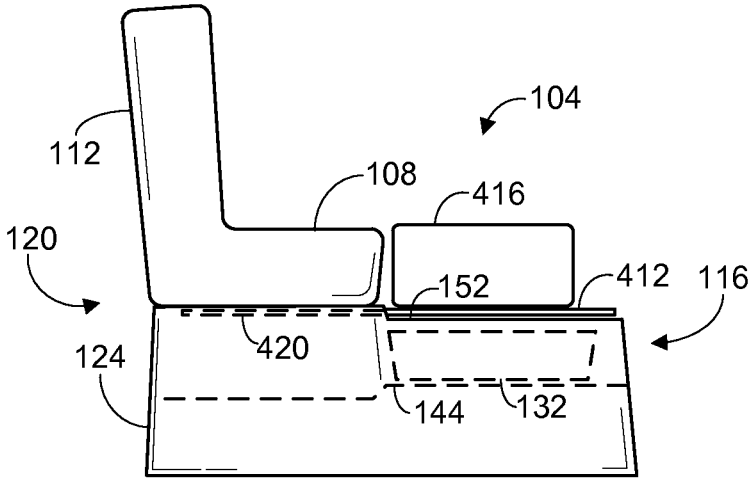
FIG. 4C is a side view of an exemplary self-cleaning pedicure spa with a retractable support in an extended position.
Figure 4D:
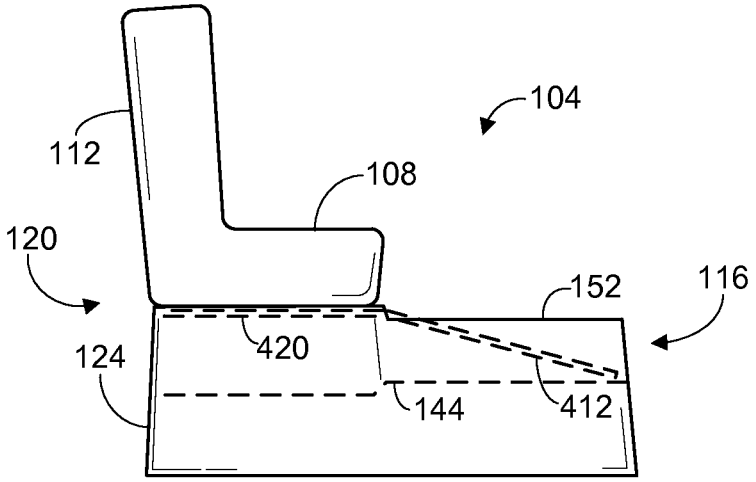
FIG. 4D is a side view of an exemplary self-cleaning pedicure spa with a retractable support in a pivoted position.

FIGS. 4C-4D illustrate a retractable support 412 that extends and retracts from below the seat 108 of the pedicure spa 104. The retractable support 412 may retract into and extend from a compartment 420 of the pedicure spa's body 124. The retractable support 412 generally provides a platform, planar support, or other structure upon which various tools or equipment 416 may be supported, such as a motorized leg/foot massager like that described above. When not in use, the retractable support 412 can be retracted for storage in the body 124 where it is hidden away. One or more rails, guides, tracks, wheels or the like may be used to movably attach the retractable support 412 to the body 124.

As shown in FIG. 4D, the retractable support 412 may comprise one or more pivots to allow the retractable support to rotate. In FIG. 4D the retractable support 412 has been rotated downward for example. In this pivoted position, the retractable support 412 can support a client's feet or various tools or equipment 416 at a lower and/or angled position. It is noted that the pivot may be configured to allow the retractable support 412 to rotate upwards as well, thus elevating the client's feet or various tools or equipment 416.

While various embodiments of the invention have been described, it will be apparent to those of ordinary skill in the art that many more embodiments and implementations are possible that are within the scope of this invention. In addition, the various features, elements, and embodiments described herein may be claimed or combined in any combination or arrangement.

What is claimed is:

1. A self-cleaning pedicure spa comprising:
- a body having a front end and a back end;
- a seat supported by the body at the back end;
- a retractable basin movable between an extended position and a retracted position and configured to hold at least one liquid therein for use during a pedicure treatment when in the extended position;
- a cleansing chamber within the back end of the body and having an opening to accept the retractable basin;
- one or more cleansing devices within the cleansing chamber configured to apply one or more cleansing products to the retractable basin when the retractable basin is in the retracted position;
- a planar platform extending outward from the opening of the cleansing chamber, wherein the retractable basin is supported by the planar platform when the retractable basin is in the extended position;
- at least one slanted portion of the planar platform that slants downward at the opening of the cleansing chamber; and
- one or more walls surrounding the planar platform except at the opening of the cleansing chamber.

2. The self-cleaning pedicure spa of claim 1, wherein the seat is located above the cleansing chamber.

3. The self-cleaning pedicure spa of claim 1, wherein the back end of the body is taller than the front end of the body.

4. The self-cleaning pedicure spa of claim 1, wherein the body forms a platform at its front end for supporting the retractable basin when the retractable basin is in the extended position.

5. The self-cleaning pedicure spa of claim 1 further comprising a stop configured to releasably secure the retractable basin within the cleansing chamber.

6. The self-cleaning pedicure spa of claim 1 further comprising one or more supply components configured to store and dispense the one or more cleansing products to the one or more cleansing devices.

7. The self-cleaning pedicure spa of claim 1, wherein at least one of the one or more cleansing devices are coupled to a municipal water supply.

8. A self-cleaning pedicure spa comprising:
- a body having a seat configured to support a client during a pedicure treatment;
- a retractable basin configured to hold at least one liquid for use during the pedicure treatment;
- a cleansing chamber within the body and having an opening to accept the retractable basin;
- a platform extending outward from the opening of the cleansing chamber;
- one or more walls extending upward at a peripheral edge of the platform except at the opening of the cleansing chamber;
- one or more supply components configured to dispense one or more cleaning products; and
- a plurality of cleansing devices within the cleansing chamber and coupled to the one or more supply components, the plurality of cleansing devices configured to apply the one or more cleansing products to the retractable basin when the retractable basin is in the cleansing chamber.

9. The self-cleaning pedicure spa of claim 8 further comprising a drain configured to drain the cleansing chamber.

10. The self-cleaning pedicure spa of claim 9, wherein the retractable basin comprises an outlet to drain the retractable basin.

11. The self-cleaning pedicure spa of claim 8 further comprising a pump configured to transfer the one or more cleansing products from the one or more supply components to the one or more cleansing devices.

12. The self-cleaning pedicure spa of claim 8 further comprising a dryer configured to dry the retractable basin when the retractable basin is in the cleansing chamber.

13. The self-cleaning pedicure spa of claim 8 further comprising a controller configured to control application of the one or more cleansing products to the retractable basin according to one or more predefined self-cleaning stages.

14. The self-cleaning pedicure spa of claim 8, wherein the platform comprises at least one slanted portion slanted downward toward the cleansing chamber.

15. A method of cleansing a basin with a self-cleaning pedicure spa comprising:
- providing a seat to support a client during a pedicure treatment;
- positioning a basin within a cleansing chamber of the pedicure spa;
- applying one or more cleansing products to the basin by one or more cleansing devices within the cleansing chamber;
- providing a walled platform at an opening of the cleansing chamber, the walled platform having one or more walls extending upward around a periphery of the platform except at the opening of the cleansing chamber;
- removing the basin from the cleansing chamber by moving the basin onto the walled platform to position the basin at an extended position.

16. The method of claim 15 further comprising storing the one or more cleansing products in one or more supply components, wherein the one or more supply components are coupled to the one or more cleansing devices.

17. The method of claim 16 further comprising coupling at least one of the one or more supply components to a municipal water source.

18. The method of claim 15 further comprising activating a stop to hold the basin within the cleansing chamber.

19. The method of claim 15 further comprising draining the cleansing chamber by opening a drain of the cleansing chamber.

20. The method of claim 15 further comprising filling the basin with one or more fluids after the basin is removed from the cleansing chamber.

* * * * *